US012529365B2

(12) United States Patent
Sharpe et al.

(10) Patent No.: US 12,529,365 B2
(45) Date of Patent: Jan. 20, 2026

(54) PROCESS FOR SENSORLESS DETECTION OF STROKE EXECUTION IN A MAGNETIC PUMP

(71) Applicant: ProMinent GmbH, Heidelberg (DE)

(72) Inventors: Markus Sharpe, Heidelberg (DE); Harald Rauh, Heidelberg (DE); Qinghai Shi, Karlsruhe (DE)

(73) Assignee: ProMinent GmbH, Heidelberg (DE)

( * ) Notice: Subject to any disclaimer, the term of this patent is extended or adjusted under 35 U.S.C. 154(b) by 161 days.

(21) Appl. No.: 18/482,242

(22) Filed: Oct. 6, 2023

(65) Prior Publication Data

US 2024/0125314 A1 Apr. 18, 2024

(30) Foreign Application Priority Data

Oct. 11, 2022 (DE) ..... 10 2022 126 376.2

(51) Int. Cl.

| | |
|---|---|
| ***F04B 43/04*** | (2006.01) |
| ***F04B 43/00*** | (2006.01) |
| ***F04B 49/06*** | (2006.01) |
| ***F04B 51/00*** | (2006.01) |

(52) U.S. Cl.

CPC ..... *F04B 43/04* (2013.01); *F04B 43/0081* (2013.01); *F04B 49/06* (2013.01); *F04B 49/065* (2013.01); *F04B 51/00* (2013.01)

(58) Field of Classification Search

CPC ..... F04B 43/04; F04B 43/0081; F04B 49/06; F04B 49/065; F04B 51/00; F04B 2203/0402; F04B 2203/0401

See application file for complete search history.

(56) References Cited

U.S. PATENT DOCUMENTS 8,807,965 B2 * 8/2014 Stenberg ..... H02K 33/10 417/63

FOREIGN PATENT DOCUMENTS

| | | | |
|---|---|---|---|
| DE | 19505219 | A1 | 8/1996 |
| DE | 102010001261 | A1 | 7/2011 |
| DE | 102014216230 | A1 | 2/2016 |

(Continued)

OTHER PUBLICATIONS

German Office Action issued on Jun. 22, 2023, in corresponding International Application No. 10 2022 126 376.2, 11 pages.

*Primary Examiner* — Charles G Freay

(74) *Attorney, Agent, or Firm* — Maier & Maier, PLLC

(57) ABSTRACT

A process for operating a pump, the pump having a conveying chamber for conveying a fluid, the pump having a displacement element, the displacement element delimiting the conveying chamber at least in sections, so that a change in the position or location of the displacement element causes a change in the volume of the conveying chamber, the pump having a drive, the drive having a coil through which an electric current is conductible, the coil having an ohmic resistance value $R_{DC}$ and an inductance $L_{coil}$, the drive includes a pressure element and a coupling device, the pressure element and the coil being configured and arranged such that a magnetic field, generated by an electric current flowing in the coil causes a stroke movement of the pressure element along a longitudinal axis from an initial position P1 to an end position P2.

20 Claims, 4 Drawing Sheets

(56) References Cited

FOREIGN PATENT DOCUMENTS

| | | | | |
|---|---|---|---|---|
| DE | 102017209272 | A1 | 12/2018 | |
| DE | 102011088699 | B4 | 7/2019 | |
| DE | 102019131388 | A1 | 5/2021 | |
| DE | 102021204408 | A1 | 11/2022 | |
| EP | 0539401 | B1 | 4/1995 | |
| EP | 2881584 | B1 | 1/2018 | |
| EP | 2995816 | B1 | 4/2020 | |
| WO | 2011124413 | A1 | 10/2011 | |
| WO | WO-2018015000 | A1 * | 1/2018 | ..... F04B 17/042 |

* cited by examiner

PROCESS FOR SENSORLESS DETECTION OF STROKE EXECUTION IN A MAGNETIC PUMP

FIELD

The present invention relates to a method for operating a pump, the pump having a conveying chamber for conveying a fluid, the pump having a displacement element, the displacement element delimiting the conveying chamber at least in sections, so that a change in the position or location of the displacement element causes a change in the volume of the conveying chamber, the pump having a drive, the drive having a coil through which an electric current is conductible, the coil having an ohmic resistance value RDC and an inductance Lcoil, the drive comprising a pressure element and a coupling device, the pressure element and the coil being configured and arranged such that a magnetic field, generated by an electric current flowing in the coil causes a stroke movement of the pressure element along a longitudinal axis from a starting position P1 to an end position P2, wherein the coupling device couples the pressure element to the displacement element such that a caused stroke movement of the pressure element causes a change of the position or the position of the displacement element, wherein the displacement element, the coupling device and the pressure element are configured and arranged such that the conveying chamber comprises a first volume when the pressure element is in the initial position P1 and the conveying chamber comprises a second volume when the pressure element is in the final position P2, the first volume being larger than the second volume.

BACKGROUND

Such pumps are also called magnetic pumps because the stroke movement of the pressure element is driven by magnetic forces generated in the coil.

When operating a magnetic pump, it is important to know the position of the pressure element and to be able to control this position. This ensures that the pressure element only moves within a stroke distance interval that is low in wear for the pump.

With diaphragm pumps, especially diaphragm dosing pumps, the monitoring and control of the stroke interval is particularly relevant. Since the pressure in the conveying chamber, which is also referred to as the dosing chamber in a dosing pump, can vary greatly, the force acting on the surface of the diaphragm located in the pressure chamber consequently also varies and is opposite to the force transmitted to the diaphragm by the pressure element during a stroke movement. A pressure variation in the dosing chamber can therefore cause the diaphragm to be deflected more than intended, namely if the force transmitted to the diaphragm by the pressure element is kept constant while the force acting on the diaphragm in the dosing chamber is particularly low.

Against this background, it is desirable to monitor and control the stroke movement of the pressure element in such a way that the force transmitted to the diaphragm via the pressure element is adjusted in order to prevent an excessive force imbalance from occurring, which can lead to an unintended excessive deflection of the diaphragm.

SUMMARY

Such monitoring and control can be made possible by the use of displacement sensors. These measure the position of the pressure element, enabling control of the movement of the pressure element in relation to the targeted stroke movement, i.e. the targeted stroke interval. However, the use of displacement sensors always requires additional electronic components. This increases the production costs of the pump as well as its susceptibility to errors. Also, additional consumption of electronic components is less sustainable for the environment.

Against this background, it is therefore a task of the present invention to provide a method as well as a pump which enable a cost-effective, safe and resource-saving monitoring and control of the stroke movement of a pressure element of a magnetically driven pump.

This task is solved by a method for operating a pump and by a pump as described in the claims.

In the following, embodiments of the invention are described in detail. The advantages of the embodiments are described in particular with reference to the diaphragm dosing pumps mentioned at the beginning. However, the advantages can also be transferred to other types of pumps with magnetic drive.

According to one embodiment of the method of operating a pump according to the invention, the pump has a conveying chamber for conveying a fluid, for example a dosing chamber, the pump having a displacement element, for example a diaphragm, the displacement element delimiting the conveying chamber at least in sections, so that a change in the position or position of the displacement element causes a change in the volume of the conveying chamber, the pump having a drive, the drive comprising a coil through which an electric current is conductible, the coil having an ohmic resistance value RDC and an inductance Lcoil, the drive comprising a pressure element and a coupling device, the pressure element and the coil being configured and arranged in such a manner that a magnetic field generated by an electric current flowing in the coil causes a stroke movement of the pressure element along a longitudinal axis from an initial position P1 to an end position P2, wherein the coupling device couples the pressure element to the displacement element such that an effected stroke movement of the pressure element causes a change in the position or the location of the displacement element, wherein the displacement element, the coupling device and the pressure element are configured and arranged such that the conveying chamber comprises a first volume when the pressure element is in the initial position P1 and the conveying chamber comprises a second volume when the pressure element is in the final position P2, the first volume being larger than the second volume. Thereby, the method comprises a first cycle, wherein the first cycle according to a first alternative comprises the following steps:

A) Establishing a desired current value $I_{SOLL}$ for the current flowing in the coil, B) applying a voltage $U_{IN}$ to the coil, C) determining a current value $I_{IST}$ of the current flowing in the coil, D) comparing the measured current value $I_{IST}$ with the desired current value $I_{SOLL}$, wherein, following step D), a case discrimination is performed with the following steps:

E) Maintaining the applied voltage $U_{IN}$ and repeating steps C) and D) if the comparison made in step D) shows that $I_{IST}$ is less than $I_{SOLL}$, F) regulating the voltage UN applied to the coil so that the current value $I_{IST}$ of the current flowing in the coil does not substantially increase further if the comparison made in step D) shows that $I_{IST}$ is greater than or equal to $I_{SOLL}$.

The desired current value $I_{SOLL}$ may be initially set based on experience sets so that $I_{SOLL}$ is equal to an experience value $I_{SOLL}^{experience}$. The value $I_{SOLL}^{experience}$ can, for example, be set in such a way that when it is reached, the start of the stroke movement of the pressure element can always be expected with a high degree of probability. However, the desired current value $I_{SOLL}$ can also have been determined on the basis of data through process steps that were carried out during an earlier operation or in cycles that took place before the first cycle.

According to a second alternative, the first cycle comprises the following steps:

A) Establishing a target time $t_{SOLL}$,

B) applying a voltage $U_{IN}$ to the coil,

C) determining the time $t_{IST}$ that has elapsed since the application of the voltage $U_{IN}$, D) comparing the measured time $t_{IST}$ with the target time $t_{SOLL}$, wherein, following step D), a case discrimination is performed with the following steps:

E) Maintaining the applied voltage UN and repeating steps C) and D) if the comparison made in step D) shows that $t_{IST}$ is less than $t_{SOLL}$, F) regulating the voltage $U_{IN}$ applied to the coil so that the current value IIST of the current flowing in the coil does not substantially increase further if the comparison made in step D) shows that $t_{IST}$ is greater than or equal to $t_{SOLL}$.

The target time may be initially set based on experience sets so that $t_{SOLL}$ is equal to an experience value $t_{SOLL}^{experience}$. The value $t_{SOLL}^{experience}$ can, for example, be set in such a way that—if a correspondingly strong voltage is applied—when it is reached, the start of the stroke movement of the pressure element can always be expected with an overwhelming probability. However, the target time $t_{SOLL}$ can also be determined on the basis of data from process steps that were carried out during an earlier operation or in cycles that took place before the first cycle.

The control in step F) ensures that the current does not increase further after the desired current value or target time has been reached and thus the magnetic force acting on the pressure element is not increased further. This makes it possible to limit the force transmitted from the pressure element to the diaphragm, for example to prevent overstretching of the diaphragm, but also to operate the pump as efficiently and energy-savingly as possible.

As soon as the voltage $U_{IN}$ is applied to the coil in step B), there is a substantially linear increase in the current value of the current flowing in the coil due to self-induction within the coil. The desired current value is preferably set such that it is reached during the phase of the linear increase caused by the self-induction. The target time is also preferably set accordingly in the second alternative.

According to one embodiment of the method according to the invention, the pump comprises a current measuring resistor with ohmic resistance value $R_S$ connected in series with the coil, the first cycle being configured according to the first alternative or according to the second alternative, the first cycle of the method comprising the following further steps:

G) Determining the current value $I_{IST}$ of the current flowing in the coil as a function of time t, H) determining a voltage $U_S$ dropping across the current measuring resistor as a function of time t, I) determining a voltage $U_C$ dropping across the coil as a function of time t, J) calculating the differential inductance LD as a function of time t on the basis of the current value $I_{IST}(t)$ determined in step G), the voltage $U_S(t)$ determined in step H) and the voltage $U_C(t)$ determined in step I), preferably according to the following formula:

$$L_D(t) = \frac{\int_0^t \left(U_C - \frac{U_S}{R_S} \cdot R_{DC}\right) dt}{di},$$

where dt is an infinitesimal time interval and where di represents an infinitesimal current value step which is preferably calculated for a time to as follows:

$$di(t_0) = I_{IST}(t_0+dt) - I_{IST}(t_0).$$

The calculation of the differential inductance LD makes it possible to determine the point in time at which the stroke movement of the pressure element is used without a sensor. This is because the differential inductance exhibits a prominent peak at this point in time, which is easily visible and detectable in a time series representation of the differential inductance.

In other words, the differential inductance rises sharply shortly before the onset of the stroke movement and falls sharply shortly after the onset of the stroke movement. At the time of the onset of the stroke movement, the differential inductance has its maximum value.

The above formulae for calculating the differential inductance and the infinitesimal current value step are analytical formulae. According to one embodiment of the method according to the invention, these analytical formulae are solved numerically by means of a computer-implemented method.

According to one embodiment, according to a further first alternative, a new desired current value $I_{SOLL,neu}$ is determined for a second cycle of the method following the first cycle as a function of the differential inductance determined in step J), or according to a further second alternative, a new target time is determined for a second cycle of the method following the first cycle as a function of the differential inductance determined in step J). In this way, the desired current value or the target time can be determined on the basis of data, which ultimately enables detection of the stroke movement of the pressure element without a sensor system.

According to one embodiment of the method according to the invention, the method comprises the following further steps:

K) Determining a limit value $L_D^{LIMIT}$ for the differential inductance,

L) comparing the differential inductance LID calculated in step J) with the limit value $L_D^{LIMIT}$, M) if the comparison made in step L) shows that the differential inductance LD exceeded the limit value $L_D^{LIMIT}$ for the first time during the first cycle at a time $t^{LIMIT}$ that has elapsed since the voltage UN was applied:

setting a new desired current value $I_{SOLL,neu}$ for a second cycle of the method following the first cycle, the new desired current value $I_{SOLL,neu}$ being set as a function of the current value $I_{IST}(t^{LIMIT})$, which has been measured at time $t^{LIMIT}$ during the first cycle, wherein the new desired current value $I_{SOLL,neu}$ preferably corresponds to the current value $I_{IST}(t^{LIMIT})$ measured at time $t^{LIMIT}$ during the first cycle; or determining a new target time $t_{SOLL,neu}$ for a second cycle of the method following the first cycle, wherein the new target time $t_{SOLL,neu}$ is determined in dependence on time value $t^{LIMIT}$, wherein the new target time $t_{SOLL,neu}$ preferably corresponds to the time $t^{LIMIT}$.

This represents a first possibility of how the time of the start of the stroke movement and/or an updated value for the desired current value can be determined from the determined values for the differential inductance. In a few preliminary tests, it can be determined which value the differential inductance assumes in any case when the stroke movement begins and at which it can nevertheless be ruled out that no false detection of a stroke movement occurs. However, this value can also be determined dynamically during operation. For example, the limit value $L_D^{LIMIT}$ can be dynamically set to a value that deviates from the previous time average value of the differential inductance by a multiple of the previous standard deviation, for example by at least three times the previous standard deviation.

According to one embodiment of the method according to the invention, the method comprises the following further steps:

N) determining whether the time variation of the differential inductance during the first cycle has a global peak at a time $t^{PEAK}$, wherein the global peak is preferably determined such that its maximum value is at least a factor of two greater than each of the chronologically earlier occurring values of the time variation of the differential inductance, O) if step N) results in the differential inductance having a global peak at time $t^{PEAK}$ establishing a new desired current value $I_{SOLL,neu}$ for a second cycle of the method following the first cycle, the new desired current value $I_{SOLL,neu}$ being established as a function of the current value $I_{IST}(t^{PEAK})$, which was measured in the first cycle at time $t^{PEAK}$, the new desired current value $I_{SOLL,neu}$ preferably corresponding to the current value $I_{IST}(t^{PEAK})$; or determining a new target time $t_{SOLL,neu}$ for a second cycle of the method following the first cycle, the new target time $t_{SOLL,neu}$ being determined as a function of time value $t^{PEAK}$, wherein the new target time $t_{SOLL,neu}$ preferably corresponds to the time $t^{PEAK}$.

This represents a second way in which the time of the start of the stroke movement and from this an updated value for the desired current value and/or the target time can be determined from the determined values for the differential inductance.

The new desired current value can also be determined, for example, in such a way that the new desired current value is formed from the product of a factor >0, preferably >1, and the value $I_{IST}(t^{LIMIT})$ or $I_{IST}(t^{PEAK})$ or from the sum of a predefined summand, which can be greater than or less than zero, but is preferably greater than zero, and the value $I_{IST}(t^{LIMIT})$ or $I_{IST}(t^{PEAK})$. The same can be applied for setting the new target time.

The steps K), L) and M) or the steps N) and O) make it possible to adapt the stroke movement to the actual pressures prevailing in the dosing chamber. A stroke movement is then only driven up to the current value at which the stroke movement started in the previous cycle. This saves energy and ensures low-wear operation.

According to one embodiment of the process according to the invention, in the event that no stroke movement is detected in the second cycle, the desired current value is reset to the initial desired current value $I_{SOLL}$ of the first cycle in the third cycle following the second cycle, if this value is greater than the desired current value that was used in the second cycle. This prevents a temporary pressure minimum in the dosing chamber and the associated reduction of the desired current value from causing a permanent standstill of the pressure element when the pressure in the dosing chamber rises again. The same can be applied for setting the target time.

During operation of the pump, a large number of cycles are often carried out one after the other, i.e. usually a large number of self-contained stroke movements. Advantageously, a continuous adaptation of the desired current value and/or the target time takes place.

According to one embodiment of the process according to the invention, step N) or step L) is carried out during each cycle or regularly always after a predefined number of cycles, such as, for example, five or ten cycles, the desired current value and/or the target time being adjusted for the subsequent cycle according to step O) or according to step M).

According to one embodiment of the process according to the invention, the process comprises a second cycle directly following the first cycle in terms of time, wherein the second cycle comprises at least steps A) to F), wherein in step A) of the second cycle the new desired current value $I_{SOLL,neu}$ determined by the first cycle is set as the desired current value for the second cycle and/or the new desired time $t_{SOLL,neu}$ determined by the first cycle is set as the desired time for the second cycle. This adapts the stroke movement to pressure variations in the dosing chamber without having to use sensors to track the stroke movement.

According to one embodiment of the process according to the invention, in which step L) is carried out, the first cycle of the process comprises the following step:

P) If step L) shows that the differential inductance LD has not exceeded the limit value during the complete first cycle:

a) issuing a warning signal and/or issuing a warning message stating that no stroke movement of the pressure element has taken place during the first cycle and/or b) maintaining the desired current value $I_{SOLL}$ of the first cycle for the second cycle immediately following the first cycle in terms of time, if the first cycle is configured according to the first alternative, or setting the desired current value of the second cycle to a stored initial value $I_{SOLL}^{experience}$, so that during the second cycle: $I_{SOLL}=I_{SOLL}^{experience}$, or maintaining the target time $t_{SOLL}$ of the first cycle for the second cycle immediately following the first cycle in terms of time, if the first cycle is configured according to the second alternative, or setting the target time of the second cycle to a stored initial value $t_{SOLL}^{experience}$, so that during the second cycle: $t_{SOLL}=t_{SOLL}^{experience}$.

For the purposes of the present invention, the terms "first cycle" and "second cycle" are to be understood as describing two cycles which follow one another in time during operation of the pump. However, the first cycle does not necessarily have to be the initial first cycle of the pump in operation. Rather, further cycles may have already taken place before the first cycle, during which a new desired current value and/or a new target time has been defined.

An initial desired current value $I_{SOLL}^{experience}$ or the initial target time $t_{SOLL}^{experience}$, both of which are based on experience values as described above, can be set for the very first start-up of the pump. Advantageously, e.g. the initial value $I_{SOLL}^{experience}$ is stored in the control system of the pump so that the desired current value can be reset to this initial value if no stroke movement takes place during a cycle, for example because the pressure in the dosing chamber has suddenly increased abruptly and the counter-pressure required for stroke execution cannot be achieved with the desired current value used at that time and also with the desired current value used in the previous cycle.

According to one embodiment of the process according to the invention, in which step N) is carried out, the first cycle of the process comprises the following step:

Q) If step N) reveals that the differential inductance LD does not have a global peak during the complete first cycle:

a) issuing a warning signal and/or preferably issuing a warning message stating that no stroke movement of the pressure element has taken place during the first cycle and/or b) maintaining the desired current value $I_{SOLL}$ of the first cycle for the second cycle immediately following in time the first cycle, if the first cycle is configured according to the first alternative, or setting the desired current value of the second cycle to a stored initial value $I_{SOLL}^{experience}$, so that during the second cycle: $I_{SOLL}=I_{SOLL}^{experience}$, or maintaining the target time $t_{SOLL}$ of the first cycle for the second cycle immediately following the first cycle in terms of time, if the first cycle is configured according to the second alternative, or setting the target time of the second cycle to a stored initial value $t_{SOLL}^{experience}$, so that during the second cycle: $t_{SOLL}=t_{SOLL}^{experience}$.

With the two previously described embodiments, consequences are also determined for the case that no stroke execution is detected during a cycle, i.e. no global peak and/or sudden steep increase in the differential inductance can be determined. The stored initial value $I_{SOLL}^{experience}$ for the desired current value can preferably be so large that stroke execution can be guaranteed when using this value as desired current value. Accordingly, the value $t_{SOLL}^{experience}$ can also be selected as a function of the applied voltage.

According to one embodiment of the process according to the invention, the process comprises the following steps, R) Determining a time interval $T_{HOLD}$, S) regulating the voltage $U_{IN}$ applied to the coil in step F) in such a way that the current value $I_{IST}$ is substantially at the value $I_{SOLL}$ immediately after the desired current value $I_{SOLL}$ has been reached or exceeded for the duration of the time interval T, T) switching off the voltage $U_{IN}$ applied to the coil when the time interval $T_{HOLD}$ ends.

The time interval $T_{HOLD}$ serves to prevent the force transmitted from the pressure element to the diaphragm from abruptly dropping to zero after the desired current value has been reached—within one cycle. By holding the current value at $I_{SOLL}$ for the time interval T, a magnetic force continues to be transmitted via the coil to the pressure element, so that it is also ensured that the stroke movement is not only initialised, but also fully executed.

The diaphragm of a diaphragm pump, which can be mounted with the aid of a spring, whereby the spring exerts a restoring force on the diaphragm that opposes the pressure element, can consequently perform a stroke movement that is optimised in terms of the stroke volume to be achieved in relation to the pressures prevailing in the dosing chamber if T and $I_{SOLL}$ are determined or adapted accordingly.

According to one embodiment of the process according to the invention, the process is a computer-implemented process. Consequently, there is advantageously no need for any manual control. In particular, the process can be implemented on the control unit of a pump or, in the case of server-controlled pumps, on the respective server used for control or on a server connected to the server used for control via a data line and/or a radio link.

The problem underlying the invention is also solved by a pump, the pump having a conveying chamber for conveying a fluid, the pump having a displacement element, the displacement element delimiting the conveying chamber at least in sections, so that a change in the position or the position of the displacement element causes a change in the volume of the conveying chamber, the pump having a drive, the drive having a coil, through which an electric current is conductible, the coil having an ohmic resistance value RDC and an inductance Lcoil, the drive comprising a pressure element and a coupling device, the pressure element and the coil being configured and arranged such that a magnetic field generated by an electric current flowing in the coil can cause a stroke movement of the pressure element along a longitudinal axis from an initial position P1 to an end position P2, wherein the coupling device couples the pressure element to the displacement element such that an effected stroke movement of the pressure element causes a change in the position of the displacement element, wherein the displacement element, the coupling device and the pressure element are configured and arranged such that the conveying chamber comprises a first volume when the pressure element is in the initial position P1 and the conveying chamber comprises a second volume when the pressure element is in the end position P2, the first volume being larger than the second volume, wherein the pump comprises a measuring device and a control device, the measuring device and the control device being arranged such that a process according to the invention is carried out according to one of the embodiments described above when the pump is in operation.

According to one embodiment of the process or pump according to the invention, the pump is a diaphragm pump, wherein the displacement element is a diaphragm, wherein the coupling device is preferably a push rod. Particularly in the case of diaphragm pumps, the use of the process has proven advantageous in practice in order to optimise the stroke movement.

According to one embodiment of the pump according to the invention, the pump comprises a spring element, wherein the spring element is configured and arranged to exert a restoring force on the displacement element directed in the direction of the initial position P1 if the displacement element is deflected from the initial position P1.

Features of a pump which have been described in connection with the process according to the invention are also features of corresponding embodiments of the pump according to the invention.

Further features, advantages and embodiments of the present invention are apparent from the figures described below. They show:

DETAILED DESCRIPTION

Figure 1:
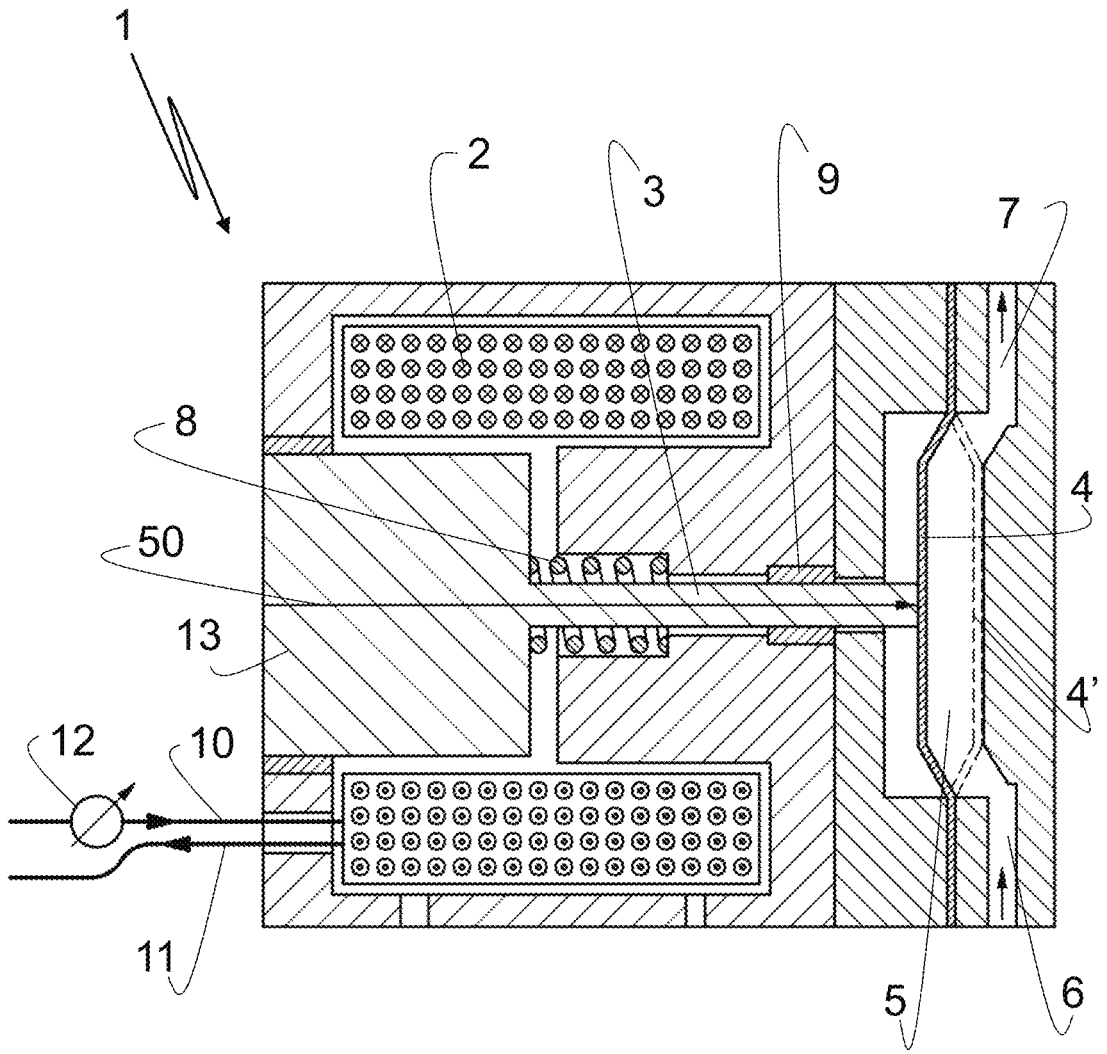
FIG. 1: a schematic cross-sectional view of an embodiment of a diaphragm pump with magnetic drive according to the invention.

In FIG. 1, a magnetically driven diaphragm dosing pump 1 according to one embodiment is shown in a cross-sectional view. This diaphragm dosing pump 1 has a coil 2 which is composed of a plurality of windings of an electrical conductor. Via the electrical connection conductors 10 and 11, the coil is connected to a voltage source 12 via an electric circuit.

If a voltage UN is applied to the coil 2 during operation of the diaphragm dosing pump 1, there is an approximately linear increase in current within the wound electrical conductors of the coil 2 due to self-induction in the coil 2.

Figure 3:
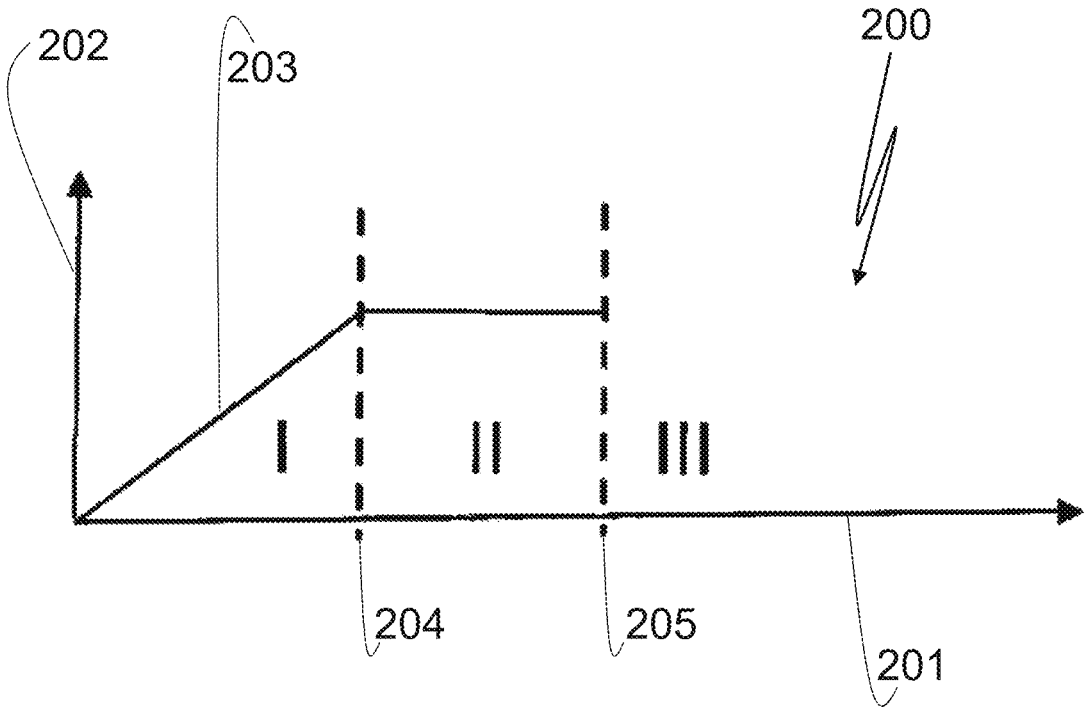

FIG. 3 shows a corresponding time-current diagram 200 for the time variation of the current 203 for the time after the voltage is switched on at the voltage source 12. The vertical axis 202 of the diagram indicates the current intensity, the horizontal axis 201 indicates the time t elapsed since the voltage was switched on. The time variation of the current is symbolised by line 203.

The approximately linear increase of the current intensity in the coil—caused by self-induction—described above can be seen very clearly in FIG. 3, namely within the time interval that extends from the point in time when the voltage is applied, i.e. from the beginning of the time axis 201, to time 204. In the embodiment shown here, time 204 corresponds to time $t^{LIMIT}$. As the current strength within the coil 2 increases, so does the field strength of the magnetic field, which is generated in the interior of the coil 2 and is approximately homogeneously configured there.

As can be seen in FIG. 1, a magnetic pressure element 13 is arranged in the interior space enclosed by the coil 2 and is mechanically coupled to the diaphragm 4, 4' of the diaphragm dosing pump 1 via a push rod 3. The coil 2 and the magnetic pressure element 13 are configured in such a way that the magnetic field building up inside the coil 2 causes a force which acts on the magnetic pressure element 13 and is directed towards the dosing chamber 5. This magnetic force is counteracted by a restoring and position-dependent spring force which is transmitted to the pressure element 13 via the spring 8. Acceleration of the pressure element 13 in the direction of the dosing chamber 5 therefore only occurs when the field strength of the magnetic field within the coil 2 has increased to such an extent that, despite the restoring force of the spring 8, a sufficient net force acts on the magnetic pressure element 13 in the direction of the dosing chamber 5.

In practice, a very sudden acceleration of the magnetic pressure element 13 occurs as soon as a sufficiently strong magnetic field has built up within the coil 2. Due to the mechanical coupling of the pressure element 13 with the diaphragm 4, 4' via the push rod 9, the resulting movement of the pressure element 13 moves the diaphragm 4, 4' from an initial position P1 (symbolised here by the diaphragm 4 shown solid) to an end position P2 (symbolised here by the dashed diaphragm 4').

The movement of the diaphragm 4, 4' from the starting position P1 to the end position P2 is the pre-stroke movement of a stroke cycle. The return stroke movement is a subsequent movement of the diaphragm from the end position P2 to the starting position P1. This is caused by the spring 8 after the voltage abutting the coil has been regulated in such a way that the magnetic force acting on the pressure element no longer compensates for the restoring force of the spring.

As can be seen in FIG. 3, the voltage is regulated from point in time 204 in such a way that the current flowing in the coil is approximately constant for a time interval T which extends between times 204 and 205, so that a magnetic field with approximately constant field strength is generated within the coil during this time. This means that the diaphragm does not perform a return stroke immediately after the pre-stroke movement. Rather, the diaphragm 4 is essentially held in the end position P2 for the time interval T. When the voltage is switched off at point in time 205, the magnetic field within the coil and thus the magnetic force acting on the pressure element is also set to zero. Consequently, the return stroke movement begins at point in time 205, since a net force now acts on the pressure element in the direction opposite to that of the pre-stroke movement due to the spring force. When the diaphragm returns to the starting position P1, a stroke cycle of the diaphragm dosing pump is completed.

Figure 4:
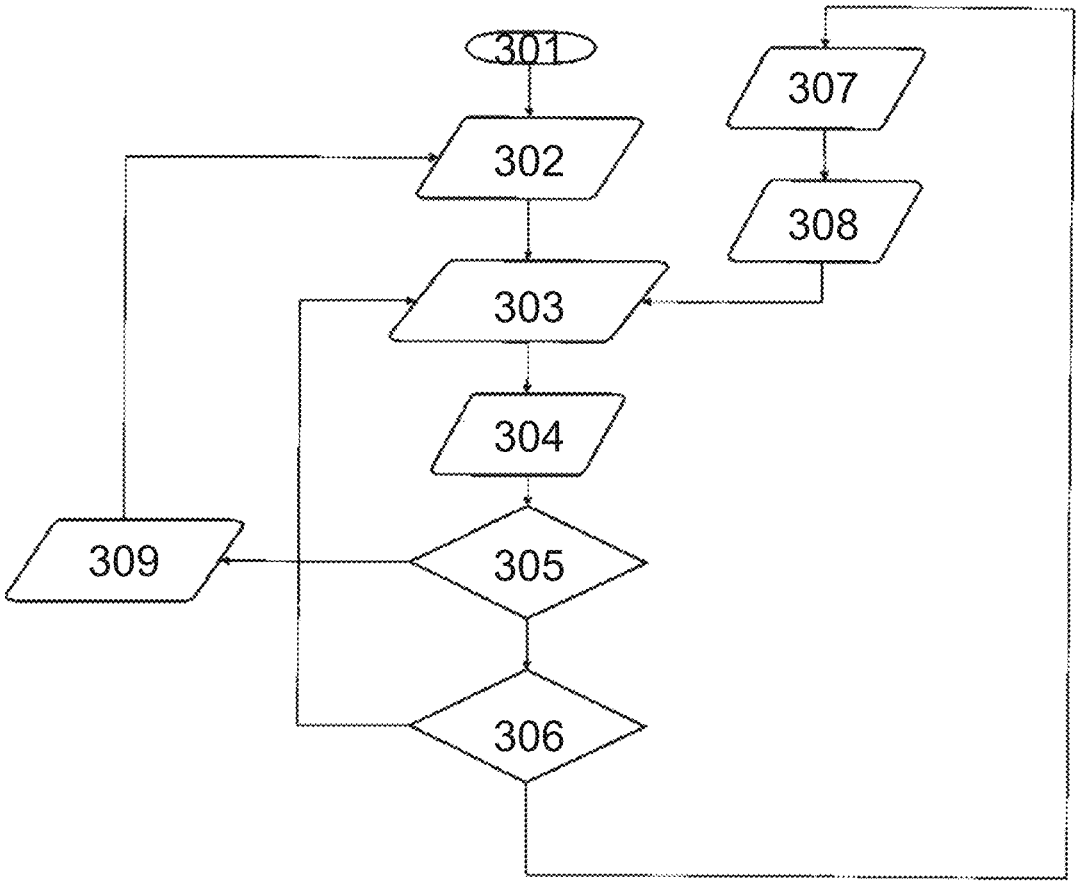
FIG. 4: an embodiment of the process according to the invention in the form of a diagram.

In FIG. 4, an embodiment of the process described here is shown again as a diagram. First, the pump is put into operation with step 301 and the process for operating a pump is started. Either an initial desired current value in the sense of the first alternative or an initial target time in the sense of the second alternative has already been determined before the process is started or the determination takes place at the same time or following the start of commissioning in step 302. In the following, the description of the process shown in FIG. 4 refers exclusively to the first alternative for a cycle in which the voltage control is coupled to a desired current value. Analogously, however, the voltage control can also be coupled to a target time in the same way.

Figure 2:
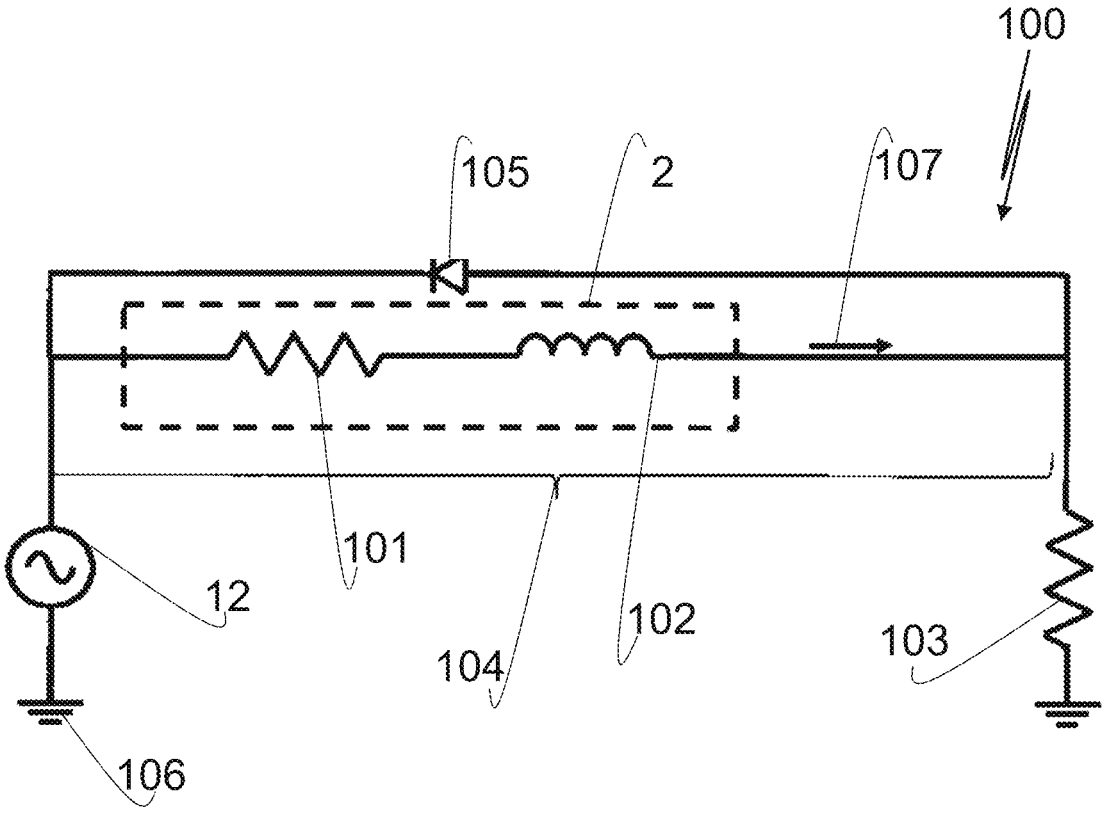
FIG. 2: an electronic circuit diagram of the magnetic drive of the diaphragm pump shown in FIG. 1, FIG. 3: a time-current diagram showing the time variation of the current flowing through the coil of the diaphragm pump shown in FIG. 1 when carrying out one embodiment of the process according to the invention.

Now, in step 303, a cycle is carried out as a function of the determined desired current value as described in the preceding paragraphs in connection with FIGS. 1 and 3. In a further step 304, which may be carried out either at least partially simultaneously with the execution of the stroke cycle in 303 or immediately following it in terms of time, the differential inductance is determined. To determine the differential inductance, the physical quantities shown in the electrical circuit diagram of FIG. 2 and known in advance are used, in particular the ohmic resistance $R_{DC}$ 101 of the coil 2, the inductance 102 of the coil 2 and the current measuring resistor $R_S$ 103. In addition, to determine the differential inductance, the time variation of the coil voltage is measured, which can be tapped between—as shown in FIG. 2—the two conductors running to the coil 2 and a diode 105 connected in parallel. The diode 105 serves as a free-wheeling diode by which voltage peaks are avoided when inductive loads of the solenoid are switched off. The arrow 107 symbolises the direction of flow of the electric current which flows through the electrical conductors of the coil 2 when a voltage is applied to the coil 2. According to the embodiment shown in FIG. 2, the voltage source 12 may provide a pulse width modulation (PWM) voltage controlled by the current flow defined in FIG. 3 to cause an alternating movement of the pressure element 13 configured as a magnetic armature.

The determination of the differential inductance now enables the step 305 shown in FIG. 4, in which it is checked whether a stroke movement, also referred to as stroke execution, has taken place at all by checking the determined time variation of the differential inductance to see whether it has a peak characteristic of a stroke execution. This can be done, for example, by checking whether the time variation has a peak whose maximum value is at least twice as large as the mean value of the differential inductance values outside the peak, i.e. for the time before and after the peak. However, other determination methods for determining a peak and thus for determining a stroke execution are also possible and are encompassed by the present disclosure.

If it has been determined in step 305 that no stroke execution has occurred, step 309 first outputs a warning message and sets a new desired current value, so that step 302 is then performed again. This can be, for example, a desired current value based on experience at which stroke execution can be expected with a probability bordering on certainty. Steps 303, 304 and 305 are then carried out again and this cycle is repeated—with desired current values that increase further and further, if necessary, until a stroke execution is detected in step 305.

If it is determined in step 305 that a stroke execution has taken place, the current intensity at the point in time when the stroke movement started is determined. The point in time at which differential inductance reaches the peak maximum also represents the point in time at which the stroke movement starts, or more precisely, the pre-stroke movement. The current value determined in this way is set as the new desired current value in step 307 and implemented as the desired current value for a further cycle following the cycle described in step 308. Then a step 303 starts again and thus the new cycle.

IIST OF REFERENCE SIGNS

1 Pump, in particular diaphragm dosing pump
2 Coil
3 Push rod
4 Diaphragm or diaphragm system when pressure element in starting position P1
4' Diaphragm or diaphragm assembly when pressure element in end position P2
5 Conveying chamber, in particular dosing chamber
6 Suction channel
7 Pressure channel
8 Spring element
9 Sealing element, in particular O-ring
10 Electrical connection
11 Electrical connection
12 Voltage source
13 Pressure element
50 Longitudinal axis
100 Circuit diagram of the coil circuit
101 Ohmic resistance of the coil Roc
102 Inductance of the coil
103 Current measuring resistor $R_S$
104 Measuring range for coil voltage $U_C$
105 Diode
106 Grounding
107 Direction of electric current
200 Diagram for the time variation of the electric current value $I_{IST}(t)$
201 Time axis t
202 Axis for current value $I_{IST}$
203 Linear increase until the value $I_{SOLL}$ is reached
204 Point in time $t^{LIMIT}$
205 Point in time $t^{LIMIT}+T$
300 Diagram
301 Start of the process
302 Setting the initial desired current value $I_{SOLL}=I_{SOLL}^{experience}$ for the current flowing in the coil
303 Execution of a cycle with steps B), C), D), E), F), G), H) and I)
304 Calculate the differential inductance LD according to step J)
305 Checking whether stroke execution has occurred
306 Determining when stroke execution has occurred
307 Set new desired current value
308 Implement new desired current value for next cycle
309 Issuing a warning message

The invention claimed is:

1. A process for operating a pump,
wherein the pump has a conveying chamber for conveying a fluid,
wherein the pump comprises a displacement element,
wherein the displacement element delimits the conveying chamber at least in sections, so that a change in the position or location of the displacement element causes a change in the volume of the conveying chamber,
wherein the pump comprises a drive,
wherein the drive comprises a coil through which an electric current can be conducted, the coil having an ohmic resistance $R_{DC}$ and an inductance $L_{coil}$,
wherein the drive comprises a pressure element and a coupling device,
wherein the pressure element and the coil are configured and arranged such that a magnetic field generated by an electric current flowing in the coil causes a stroke movement of the pressure element along a longitudinal axis from an initial position P1 to an end position P2,
wherein the coupling device couples the pressure element to the displacement element such that an effected stroke movement of the pressure element causes a change of the position or the location of the displacement element,
wherein the displacement element, the coupling device and the pressure element are configured and arranged such that the conveying chamber comprises a first volume when the pressure element is in the initial position P1 and the conveying chamber comprises a second volume when the pressure element is in the final position P2, the first volume being larger than the second volume,
the process comprising a first cycle,
the first cycle comprising the following steps according to a first alternative:
A) setting a desired current value $I_{SOLL}$ for the current flowing in the coil,
B) applying a voltage $U_{IN}$ to the coil,
C) determining a current value $I_{IST}$ of the current flowing in the coil,
D) comparing the determined current value $I_{IST}$ with the desired current value $I_{SOLL}$,
wherein, following step D), a case discrimination is performed with the following steps:
E) maintaining the applied voltage $U_{IN}$ and repeating steps C) and D) if the comparison made in step D) shows that the determined current value $I_{IST}$ is less than $I_{SOLL}$, or
F) regulating the applied voltage $U_{IN}$ so that the determined current value $I_{IST}$ of the current flowing in the coil does not substantially increase further if the comparison made in step D) shows that the determined current value $I_{IST}$ is greater than or equal to $I_{SOLL}$, or wherein the first cycle comprises the following steps according to a second alternative:

A) setting a target time $t_{SOLL}$,

B) applying the voltage $U_{IN}$ to the coil,

C) determining a time $t_{IST}$ that has elapsed since the application of the voltage $U_{IN}$, D) comparing the determined time $t_{IST}$ with the target time $t_{SOLL}$, wherein, following step D), a case discrimination is performed with the following steps:

E) maintaining the applied voltage $U_{IN}$ and repeating steps C) and D) if the comparison made in step D) shows that the determined time tis is less than $t_{SOLL}$, or F) determining the current value $I_{IST}$ of the current flowing in the coil and regulating the voltage $U_{IN}$ applied to the coil so that the current value $I_{IST}$ of the current flowing in the coil does not substantially increase further if the comparison made in step D) shows that the determined time $t_{IST}$ is greater than or equal to $t_{SOLL}$.

2. The process according to claim 1, wherein the pump comprises a current measuring resistor with an ohmic resistance value $R_S$ connected in series with the coil, wherein the first cycle is configured according to the first alternative or according to the second alternative, the first cycle of the process comprising the following further steps:

G) further determining, for the current value $I_{IST}$ of the current flowing in the coil, a current function $I_{IST}(t)$ that is a function of time t, H) determining a voltage $U_S$ dropping across the current measuring resistor as a function of time t, I) determining a voltage $U_C$ dropping across the coil as a function of time t, J) calculating a differential inductance LD as a function of time t on the basis of the current value $I_{IST}(t)$ determined in step G), the voltage $U_S$ (t) determined in step H) and the voltage $U_C(t)$ determined in step I).

3. The process according to claim 2, wherein one of:

a new desired current value $I_{SOLL,\ neu}$ is set for a second cycle of the process following the first cycle as a function of the differential inductance determined in step J), or a new target time $t_{SOLL}$, neu is set for a second cycle of the process following the first cycle, as a function of the differential inductance determined in step J).

4. The process according to claim 2, wherein the process comprises the following further steps:

K) setting a limit value $L_D^{LIMIT}$ for the differential inductance,

L) comparing the differential inductance $L_D$ calculated in step J) with the limit value $L_D^{LIMIT}$, M) if the comparison made in step L) shows that the differential inductance $L_D$ exceeded the limit value $L_D^{LIMIT}$ for a first time during the first cycle at a time $t^{LIMIT}$ that has elapsed since the voltage $U_{IN}$ was applied:

setting a new desired current value $I_{SOLL,\ neu}$ for a second cycle of the process following the first cycle, the new desired current value $I_{SOLL,\ neu}$ being set as a function of the current value $I_{IST}$ ($t^{LIMIT}$), which was measured at time $t^{LIMIT}$ during the first cycle; or setting a new target time $t_{SOLL,\ neu}$ for a second cycle of the process following the first cycle, wherein the new target time $t_{SOLL,\ neu}$ is set in dependence on time value $t^{LIMIT}$.

5. The process according to claim 2, wherein the process comprises the following further steps:

N) determining whether a time variation of the differential inductance during the first cycle has a global peak at a point in time $t^{PEAK}$, O) if step N) results in the differential inductance having the global peak at the point in time $t^{PEAK}$:

setting a new desired current value $I_{SOLL,\ neu}$ for a second cycle of the process following the first cycle, the new desired current value $I_{SOLL,\ neu}$ being set as a function of the current value $I_{IST}(t^{PEAK})$, which was measured in the first cycle at point in time $t^{PEAK}$; or setting a new target time $t_{SOLL,\ neu}$ for a second cycle of the process following the first cycle, the new target time $t_{SOLL,\ neu}$ being set as a function of time value $t^{PEAK}$.

6. The process according to claim 3, wherein the process comprises a second cycle immediately following in time the first cycle, wherein the second cycle comprises at least steps A) to F) according to the first alternative or steps A) to F) according to the second alternative, wherein in step A) of the second cycle the new desired current value $I_{SOLL,\ neu}$ determined by the first cycle is set as the desired current value for the second cycle and/or the new target time $t_{SOLL,\ neu}$ determined by the first cycle is set as the desired time for the second cycle.

7. The process according to claim 4, wherein the first cycle of the process comprises the following step:

P) If step L) shows that the differential inductance $L_D$ has not exceeded the limit value during the complete first cycle:

a) issuing a warning signal and/or issuing a warning message stating that no stroke movement of the pressure element has taken place during the first cycle and/or b) maintaining the desired current value $I_{SOLL}$ of the first cycle for the second cycle immediately following in time the first cycle, if the first cycle is configured according to the first alternative, or setting the desired current value of the second cycle to a stored initial value $I_{SOLL}^{experience}$, so that during the second cycle: $I_{SOLL}=I_{SOLL}^{experience}$, or maintaining the target time $t_{SOLL}$ of the first cycle for the second cycle immediately following in time the first cycle, if the first cycle is configured according to the second alternative, or setting the target time of the second cycle to a stored initial value $t_{SOLL}^{experience}$, so that during the second cycle: $t_{SOLL}=t_{SOLL}^{experience}$.

8. The process according to claim 5, wherein the first cycle of the process comprises the following step:

Q) if step N) results in the differential inductance $L_D$ not having a global peak during the complete first cycle:

a) emitting a warning signal and/or preferably-emitting a warning message stating that no stroke movement of the pressure element has occurred during the first cycle and/or b) maintaining the desired current value $I_{SOLL}$ of the first cycle for the second cycle immediately following in time the first cycle, if the first cycle is configured according to the first alternative, or setting the desired current value of the second cycle to a stored initial value $I_{SOLL}=I_{SOLL}^{experience}$ or maintaining the target time $t_{SOLL}$ of the first cycle for the second cycle immediately following in time the first cycle, if the first cycle is configured according to the second alternative, or setting the target time of the second cycle to a stored initial value $t_{SOLL}^{experience}$, so that during the second cycle: $t_{SOLL}=t_{SOLL}^{experience}$.

9. The process according to claim 2, wherein the process comprises the following steps, R) setting a time interval T, S) regulating the applied voltage $U_{IN}$ in such a way that the determined current value $I_{IST}$ is substantially at the value $I_{SOLL}$ immediately after reaching or exceeding the desired current value $I_{SOLL}$ for the duration of the time interval T, T) switching off the voltage $U_{IN}$ applied to the coil when the time interval T ends.

10. The process according to claim 2, wherein the process is a computer-implemented process.

11. The process according to claim 2, wherein the pump is a diaphragm pump, and wherein the displacement element is a diaphragm.

12. A pump, wherein the pump comprises a conveying chamber for conveying a fluid, wherein the pump comprises a displacement element, wherein the displacement element delimits the conveying chamber at least in sections, so that a change in the position of the displacement element causes a change in the volume of the conveying chamber, wherein the pump comprises a drive, wherein the drive comprises a coil through which an electric current can be conducted, the coil having an ohmic resistance $R_{DC}$ and an inductance $L_{coil}$, wherein the drive comprises a pressure element and a coupling device, wherein the pressure element and the coil are configured and arranged such that a magnetic field generated by an electric current flowing in the coil can cause a stroke movement of the pressure element along a longitudinal axis from an initial position P1 to an end position P2, wherein the coupling device couples the pressure element to the displacement element such that an effected stroke movement of the pressure element causes a change in the position of the displacement element, wherein the conveying chamber, the coupling device and the pressure element are configured and arranged such that the conveying chamber comprises a first volume value when the pressure element is in the initial position P1 and the conveying chamber comprises a second volume value when the pressure element is in the final position P2, wherein the first volume value is greater than the second volume value, wherein the pump comprises a measuring device and a control device, wherein the measuring device and the control device are arranged to perform a process according to claim 1 when the pump is in operation.

13. The pump according to claim 10, wherein the pump comprises a spring element, wherein the spring element is configured and arranged to exert a restoring force on the displacement element directed towards the initial position P1 if the displacement element is deflected from the initial position P1.

14. The process according to claim 2, wherein the differential inductance $L_D$ is calculated according to the analytical formula:

$$L_D(t) = \frac{\int_0^t \left(U_C - \frac{U_S}{R_S} \cdot R_{DC}\right) dt}{di},$$

where dt is an infinitesimal time interval and where di represents an infinitesimal current value step.

15. The process according to claim 14, wherein di is calculated for a point in time to as follows:

$$di(t_0)=I_{IST}(t_0+dt)-I_{IST}(t_0).$$

16. The process according to claim 4, wherein the new desired current value $I_{SOLL,\ neu}$ corresponds to the current value $I_{IST}(t^{LIMIT})$ measured at time $t^{LIMIT}$ during the first cycle; or wherein the new target time $t_{SOLL,\ neu}$ corresponds to the time $t^{LIMIT}$.

17. The process according to claim 5, wherein the global peak is determined such that its value is greater than any time varying values of a time variation of the differential inductance.

18. The process according to claim 5, wherein the new desired current value $I_{SOLL,\ neu}$ corresponds to the current value $I_{IST}(t^{PEAK})$; or wherein the new target time $t_{SOLL,\ neu}$ corresponds to the time $t^{PEAK}$.

19. The process according to claim 8, wherein in Step Q) a), the warning message is emitted.

20. The process according to claim 11, wherein the coupling device is a push rod.

* * * * *